United States Patent [19]

Mizoguchi et al.

[11] Patent Number: 5,071,493

[45] Date of Patent: Dec. 10, 1991

[54] RARE EARTH-IRON-BORON-BASED PERMANENT MAGNET

[75] Inventors: Tetsuhiko Mizoguchi; Isao Sakai; Koichiro Inomata, all of Yokohama, Japan

[73] Assignee: Kabushiki Kaisha Toshiba, Kawasaki, Japan

[21] Appl. No.: 470,748

[22] Filed: Jan. 26, 1990

Related U.S. Application Data

[63] Continuation of Ser. No. 142,356, Dec. 28, 1987, abandoned, which is a continuation of Ser. No. 843,286, Mar. 24, 1986, abandoned.

[30] Foreign Application Priority Data

Mar. 28, 1985 [JP] Japan ..... 60-61837

[51] Int. Cl.[5] ..... H01F 1/04

[52] U.S. Cl. ..... 148/302; 420/83; 420/121

[58] Field of Search ..... 148/302; 420/83, 121

[56] References Cited

FOREIGN PATENT DOCUMENTS 0101552 2/1984 European Pat. Off. .
0106948 5/1984 European Pat. Off. .

OTHER PUBLICATIONS

Sagawa et al., "New Material for Permanent Magnets on a Base of Nd and Fe", Appl. Phys. 55(6), Mar. 15, 1984 pp. 2083–208 7.

*Primary Examiner*—John P. Sheehan
*Attorney, Agent, or Firm*—Oblon, Spivak, McClelland, Maier & Neustadt

[57] ABSTRACT

There is disclosed a permanent magnet comprising a sintered alloy composed of rare earth elements (R), boron and iron. This permanent magnet is substantially constituted by 2-phase systems, i.e. a ferromagnetic Fe-rich phase ($Nd_2Fe_{14}B$) and a nonmagnetic R-rich phase ($Nd_{97}Fe_3$), and has $BH_{max}$ of more than 38.0 MGOe.

21 Claims, 1 Drawing Sheet

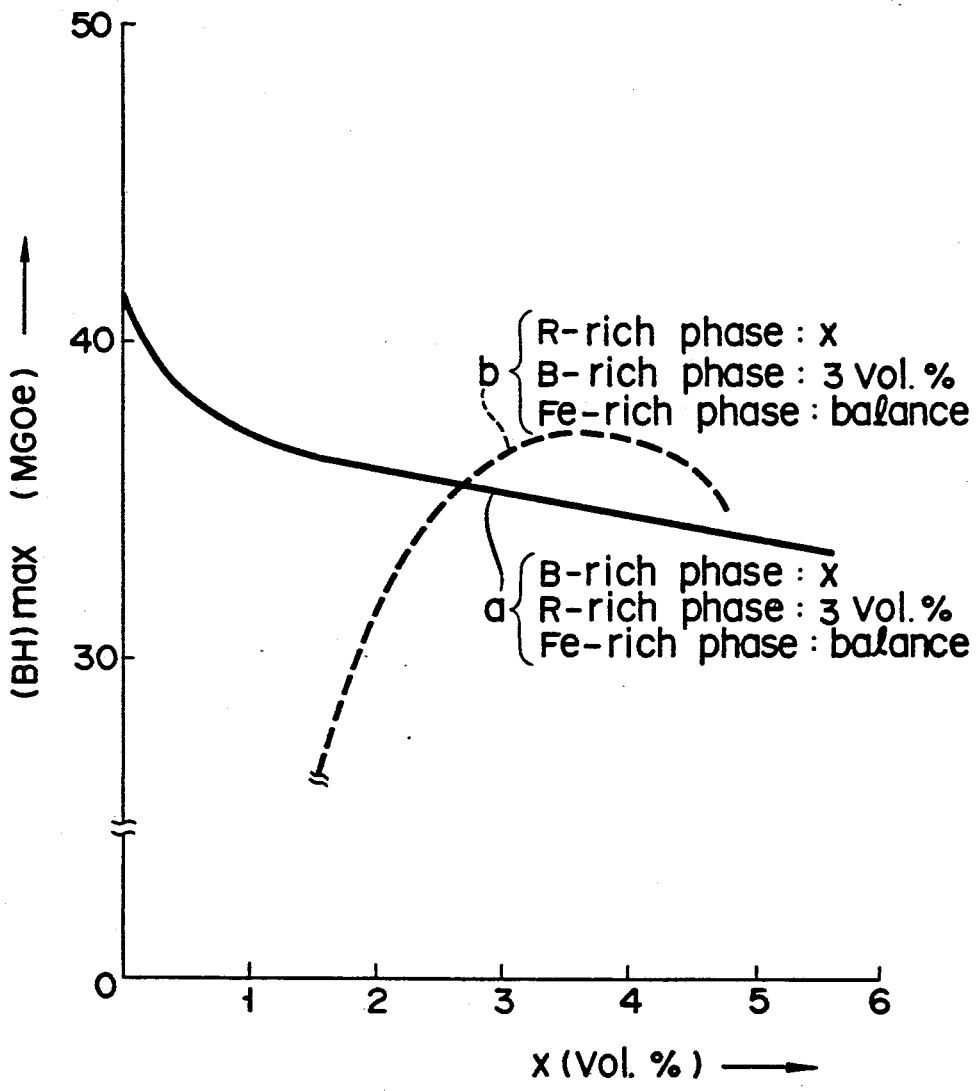
50
40
30
0
(BH) max (MGOe)
b
R-rich phase : x
B-rich phase : 3 vol. %
Fe-rich phase : balance
a
B-rich phase : x
R-rich phase : 3 vol. %
Fe-rich phase : balance
1
2
3
4
5
6
x (Vol. %)

RARE EARTH-IRON-BORON-BASED PERMANENT MAGNET

This application is a continuation of abandoned application Ser. No. 07/142,356, filed Dec. 28, 1987 which in turn is a continuation of abandoned application Ser. No. 06/843,286, filed Mar. 24, 1986.

BACKGROUND OF THE INVENTION (a) Field of the Invention

This invention relates to a rare earth-iron-boron-based permanent magnet having a large maximum energy product $BH_{max}$.

(b) Description of the Prior Art

A rare earth-cobalt-base magnet composed of, for example, $R_2(CoCuFeM)_{17}$ in well-known as a high performance magnet. This rare earth-cobalt-based magnet has the maximum energy product ($BH_{max}$) of 30 MGOe at most. Recently, there has been a strong demand for more compact electron implements with high performance. There has also been a great need for a high performance magnet with a far higher maximum energy product $BH_{max}$. However, such rare earth-cobalt-based-magnets require heavy consumption of relatively expensive cobalt.

To meet the above-mentioned requirements, research has been ongoing in various entities in this particular field to develop a rare earth magnet mainly consisting of iron (refer to, for example, patent disclosure Sho 59-46008). This permanent magnet substantially consists of iron, and contains boron and rare earth elements such as neodymium and praseodymium. The developed magnet can provide a sample whose $BH_{max}$ has a larger value than 30 MGOe. This product mainly composed of less expensive Fe than Co ensures the manufacture of a high performance magnet at low cost, and is consequently regarded as very hopeful magnetic material. For further elevation of magnetic performance, various studies have been undertaken, for example, addition of Co (patent disclosure Sho 59-64733), addition of Al, Ti, V, Cr, Mn, Zr, Hf, Nb, Ta, Mo, Ge, Sb, Sn, Bi, Ni (patent disclosures 59-89401 and 59-132104) and addition of Cu, S, C, P (patent disclosures 59-132105 and 59-163803), and the combinations of the above listed materials (patent disclosures 59-163804 and 59-163805).

However, the above-mentioned rare earth-iron-based permanent magnets are more strongly demanded to display a for larger maximum energy product $BH_{max}$, and research and development are being carried on in various quarters of this particular industry.

SUMMARY OF THE INVENTION

It is accordingly the object of this invention to provide a rare earth-iron-boron-based permanent magnet which has a prominent maximum energy product ($BH_{max}$) and other satisfactory magnetic properties.

To attain the above-mentioned object, this invention provides a rare earth-iron-boron-based permanent magnet comprising a sintered body containing rare earth elements (including yttrium) (hereinafter referred to as R), boron, and iron as the remainder; wherein the sintered body is substantially represented by a 2-phase system composed of a ferromagnetic Fe-rich phase and a nonmagnetic R-rich phase.

The conventional rare earth-iron-based permanent magnet is known to be a 3-phase system comprising a ferromagnetic Fe-rich phase, R-rich phase and B-rich phase [IEEE Trans Magn. MAG-20, 1584 (1984)]. The quantities of the respective phases of said proposed permanent magnet vary with the intended composition and manufacturing conditions. The present inventors have proceeded with their research work with attention paid to the relationship between the structure of said proposed product and its magnetic property. As a result, it has been disclosed that when the proposed product is represented by a 2-phase system consisting of a ferromagnetic Fe-rich phase and nonmagnetic R-rich phase, namely, is substantially free from a B-rich phase, then said product indicates a uniquely great maximum energy product ($BH_{max}$), thereby providing a rare earth-iron-based permanent magnet, thus leading to the present invention.

BRIEF DESCRIPTION OF THE DRAWING

The appended drawing is a curve diagram showing the relationship between the composition of a permanent magnet and its maximum energy product ($BH_{max}$).

DETAILED DESCRIPTION OF THE PREFERRED EMBODIMENTS

Description may now be made of a permanent magnet embodying this invention which contains a rare earth element R [presented by neodymium (Nd)], boron, and iron as the remainder.

The rare earth-iron-boron-based permanent magnet of this invention is a substantially only 2-phase system, composed of a tetragonal ferromagnetic Fe-rich phase of intermetallic $Nd_2Fe_{14}B$ compound and a cubic nonmagnetic R-rich phase having R value of over 90%, for example, $Nd_{97}Fe_3$. Namely, the rare earth-iron-boron based permanent magnet of the present invention has a tetragonal system substantially free from a tetragonal R-rich phase ($Nd_2Fe_7B_6$). This also applies to the case where the R component is formed of any other rare earth elements than Nd.

The permanent magnet of this invention represents a system wherein the ferromagnetic Fe-rich phase constitutes a main component and a nonmagnetic R-rich phase is present in the matrix of said ferromagnetic Fe-rich phase. The quantity of the Fe-rich phase is related to the magnetic flux density. Namely, the magnetic flux density becomes greater as the Fe-rich phase increases in quantity. The R-rich phase contributes to the elevation of the sintering property and consequently the magnetic flux density, and is also closely relation to the coercivity. Both Re-rich and R-rich phases are indispensable for the permanent magnet of this invention. FIG. 1 indicates the relationship between the respective phases of the permanent magnet of the invention and its maximum energy product $BH_{max}$. Solid line "a" indicates the above-mentioned relationship in the case where the content of the R-rich phase was fixed to 3 vol. %, and the content of the B-rich phase was changed. Broken line "b" shows said relationship in the case where the content of the B-rich phase was fixed to 3 vol. %, and the content of the R-rich phase was varied. As clearly seen from solid line "a", the subject ferromagnetic product uniquely increases in maximum energy product $BH_{max}$ when composed of the Fe-rich and R-rich phases. In contrast, broken line "b" indicates that when containing the B-rich phase, the permanent magnet decreases in magnetic property, even if the R-rich phase is changed in quantity. Further, FIG. 1 proves that the subject permanent magnet is in the best condition when free from the B-rich phase; the quantity of the B-rich phase is preferred to be less than 1 vol. %, more preferably less than 0.5 vol. %, because the substantial absence of the B-rich phase elevates the property of the subject permanent magnet; and the content of the R-rich phase is preferred to range between 2.5 and 5 vol. %.

The composition of permanent magnet of the present invention can be varied, insofar as the production of both Fe-rich and R-rich phases can always be ensured. However, the permanent magnet of the invention substantially contains 10–40% by weight of R, 0.8 to 1.1% by weight of B and Fe as the remainder.

Less than 10% by weight of R causes the subject permanent magnet to fall in coercivity. In contrast, more than 40% by weight of R leads to a decline in Br (residual magnetic flux density), and also in the maximum energy product $BH_{max}$. Therefore, the quantity of R in preferred to range between 10 and 40% by weight.

Among the rare earth elements, Nd and Pr are particularly effective to cause the subject permanent to have a prominent maximum energy product ($BH_{max}$). It is preferred that R be possessed of at least one of said two rare earth elements Nd and Pr. It is further desired that the content of Nd, or Pr or Nd+Pr in the whole quantity of R be more than 70% by weight (or represent the whole quantity of R).

The content of boron B is preferred to range between 0.8 and 1.1% by weight, because less than 0.8% by weight of boron B results in a decrease in the coercivity (iHc) of the subject permanent magnet, whereas more than 1.1% by weight of boron B leads to a noticeable drop in Br.

Part of B may be replaced by C, N, Si, P, or Ge. This replacement ensures an increase in the sintering property of the subject permanent magnet and consequently the elevation of Br and maximum energy product ($BH_{max}$). In this case, it is advised that the ratio of said replacement should be limited to less than about 80 atm. % of B.

The alloy type permanent magnet embodying the present invention is fundamentally based on a ternary system represented by R-Fe-B. Part of Fe may however be replaced by Co, Cr, Al, Ti, Zr, Hf, Nb, Ta, V, Mr, Mo, W, Ru, Rh, Re, Pd, Os, or Ir. These additives may be selectively incorporated in any of the phases B, Fe, and R in accordance with the physico-chemical properties of said additives. In this case, it is preferred that the incorporation of any of the above-listed additives by limited to about 20 atm. % of the above-mentioned phase B, Fe or R, because an excess addition results in the deterioration of the magnetic properties of the subject permanent magnet including a decline in its maximum energy product ($BH_{max}$). Additives Co, Ru, Rh, Pd, Re, Os and Ir in particular contribute to an increase in the Curie temperature and also in the temperature characteristics of the magnetic property. Cr and Al effectively elevate corrusion resistance. Ti is effective to ensure a rise in the Curie temperature and coercivity and an elevation in the temperature characteristics of the magnetic property. Co and Al in particular contribute to the elevation of the magnetic properties of the subject permanent magnet. It is preferred that the addition of Co be limited to about 1 to 20% by weight, and that of Al be limited to about 0.4 to 2% by weight.

The permanent magnet embodying this invention is manufactured through the undermentioned steps. First, an alloy of permanent magnet containing the predetermined quantities of R, Fe, and B phases is prepared. Later, the alloy of permanent magnet is crushed, for example, in a ball mill. In this case, the pulverization should preferably be carried out to the extent of about 2 to 10 microns in average particle size in order to facilitate the succeeding step involving sintering. The reason is as follows. If the particle size exceeds 10 microns, the magnetic flux density will fall. Pulverization of the above-mentioned alloy of permanent magnet could hardly be carried out to a smaller particle size than 2 microns. Moreover, such minutes crushing leads to a decline in the magnetic properties of the subject alloy type permanent magnet including coercivity.

The oxygen content in the subject alloy type permanent magnet been great importance for its property. For instance, a large oxygen content will invite a decline in the coercivity of the subject permanent magnet, preventing it from obtaining a large maximum energy product ($BH_{max}$). Therefore, it is preferred that the oxygen content by smaller than 0.03% by weight. Conversely, if the oxygen content is excessively small, difficulties will be presented in crushing the raw alloy, thus increasing the cost of manufacturing the subject alloy type permanent magnet. It is demanded to carry out pulverization to a minute extent of 2 to 10 microns. If, however, an oxygen content is small, difficulties will be encountered in minute pulverization. In such case, the particle size will be ununiform, and orientation property will fall during molding in the magnetic field, thus resulting in a decrease in Br and consequently a fall in the maximum energy product ($BH_{max}$). Consequently the oxygen content should preferably range between 0.005 to 0.03% by weight.

Though the behavior of oxygen in the alloy type permanent magnet is not yet clearly defined, it is assumed that the presence of oxygen will contribute the manufacture of a highly efficient permanent magnet due to its behavior presumably occurring as follows. Part of the oxygen contained in the melted alloy is bonded with the main elements of R and Fe atoms to provide oxides. It is assumed that said oxides remain together with the residual oxygen in the segregated form, for example, crystal boundaries. Particularly, the oxides are absorbed in the R-rich phase to obstruct the magnetic property of the subject permanent magnet. When it is considered that the R-Fe-B type magnet consists of finally comminuted particulate magnets, and the coercivity of said magnet is determined mainly due to the occurrence of an opposite domain-producing magnetic field, the prominent occurrence of oxides and segregations will act as the source of said opposite domain, thus resulting in a decline in the coercivity of the subject permanent magnet. Further in case the above-mentioned defects represented by the occurrence of the oxides and segregation become too scarce, the destruction of the crystal foundaries is less likely to take place, thus presumably deteriolating the pulverization property thereof.

The oxygen content in the permanent magnet alloy can be controlled by the application of highly pure raw materials and the precise regulation of the oxygen content in the furnace when the raw alloy metals are melted. The pulverized mass obtained in the above-mentioned step is molded into a predetermined shape. When said molding is performed, magnetization is applied to the extent of, for example, 15KOe units as in the manufacture of the ordinary sintered magnet. Then, the molded mass is sintered at a temperature ranging between 1000° and 1200° C. for a period ranging approximately from 0.5 to 5 hours.

It is preferred that the above-mentioned sintering be carried out in an atmosphere of inert gas such as argon or in a vacuum of $10^{-4}$ Torr. or more. After sintering, it is preferred that cooling be performed at a quicker speed than 50° C./min. For the elevation of the magnetic property of the subject permanent magnet, it is possible to subject the sintered body to aging at a temperature ranging between 400° and 1100° C. for a period of about 1 to 10 hours.

The invention will become more apparent with reference to the following examples.

EXAMPLE 1

An alloy composed of 32.6% by weight of Nd having a higher purity than 99.9%, 1.0% by weight of B having a higher purity than 99.8% and Fe as the remainder is arc melted in an atmosphere of argon. After cooled, the mass was roughly crushed to the extent of passing a 20-mesh screen. The crushed powders were minutely pulverized in a ball mill in an inorganic solvent to the extent of average particle size of 3 microns. The finally comminuted powders were molded in a magnetic field of 15KOe. After degassed in vacuum under the condition of 300° C.×1H, the molded mass was sintered in an atmosphere of argon at $5\times10^{-1}$ Torr under the condition of 1100° C.×1H. The degassed molded mass was cooled to room temperature at a decrement of 80° C./min, thereby providing to permanent magnet embodying this invention.

By way of comparison, a control permanent magnet was fabricated substantially under the same conditions as in Example 1, except that B was added to an extent of 1.5% by weight. Table 1 below sets forth the various data on the magnetic properties and metal compositions of the permanent magnets obtained in Example 1 and Control 1.

TABLE 1

| | Br (KG) | IHc (KOe) | (BH) max (MG Oe) | Fe-rich phase (vol. %) | R-rich phase (vol. %) | B-rich phase (vol. %) |
|---|---|---|---|---|---|---|
| Example 1 | 13.3 | 8.0 | 41 | 96.5 | 3.5 | <0.1 |
| Control 1 | 12.2 | 10.0 | 34 | 92.7 | 3.1 | 4.2 |

The various phases of the permanent magnet composition indicates in Table 1 above were determined by electron probe microanalysis (EPMA). (The same applied to the undermentioned Example 2).

Table 1 above clearly shows that the permanent magnet embodying this invention has a larger maximum energy product $BH_{max}$.

EXAMPLE 2

A permanent magnet was produced substantially in the same manner as in Example 1, except that the subject permanent magnet was composed of 32.6% by weight of Nd, 0.97% by weight of B, 14.4% by weight of Co, 0.59% by weight Al and iron as the remainder.

CONTROL 2

A permanent magnet was fabricated which was formed of 33.2% by weight of Nd, 1.34% by weight of B, 14.6% by weight of Co, 0.76% by weight of Al and iron as the remainder.

Table 2 below indicates the various data on the magnetic properties and metal compositions of the permanent magnets fabricated in Example 2 and Control 2.

TABLE 2

| | Br (KG) | IHc (KOe) | (BH) max (MG Oe) | Fe-rich phase (vol. %) | R-rich phase (vol. %) | B-rich phase (vol. %) |
|---|---|---|---|---|---|---|
| Example 2 | 12.9 | 11.3 | 38.0 | 97.1 | 2.8 | <0.1 |
| Control 2 | 11.5 | 10.1 | 31.1 | 93.8 | 3.2 | 3.0 |

What is claimed is:

1. A permanent magnet formed of a sintered alloy, comprising:
   (i) 10 to 40% by weight of at least one metal element selected from the group consisting of the rare earth elements (R) and yttrium, (ii) 0.8 to 1.1% by weight boron and (iii) the balance iron, wherein said sintered alloy consists essentially of a ferromagnetic Fe-rich phase as the main phase, 2.5 to 5.0% by volume of a R-rich phase and less than 1% by volume of a B-rich phase, said alloy having a maximum energy product ($BH_{max}$) of at least 38.0 MGOe.

2. The permanent magnet according to claim 1, wherein the oxygen content of the alloy ranges between 0.005 and 0.03% by weight.

3. The permanent magnet according to claim 17, wherein said B-rich phase consists of the alloy $Nd_2Fe_7B_6$.

4. The permanent magnet according to claim 1, wherein the content of the B-rich phase is less than 0.5 vol. %.

5. The permanent magnet according to claim 1, wherein R represents Nd.

6. The permanent magnet according to claim 1, wherein R contains more than 70% by weight of Nd.

7. The permanent magnet according to claim 1, wherein R represents Pr.

8. The permanent magnet according to claim 1, wherein R contains more than 70% by weight of Pr.

9. The permanent magnet according to claim 1, wherein the Fe-rich phase is formed of a tetragonal system of $Nd_2Fe_{14}B$.

10. The permanent magnet according to claim 1, wherein the R-rich phase contains more than 90 atm. % of R.

11. The permanent magnet according to claim 1, wherein less than 80 atm. % of the boron content is replaced by C, N, Si, P, or Ge.

12. The permanent magnet according to claim 1, wherein part of the Fe content is replaced by Co, Al or Co+Al.

13. The permanent magnet according to claim 12, wherein the content of Co is 1 to 20% by weight and the content of Al is 0.4 to 2% by weight (as measured on the basis of the content of Fe).

14. A permanent magnet formed of a sintered alloy, comprising:
   10 to 40% by weight of at least one element selected from the group consisting of the rare earth metals (R) and yttrium, 0.8 to 1.1% by weight boron and with the balance being iron, wherein said sintered alloy comprises at least 96.5% by volume of a ferromagnetic Fe-rich phase as the main phase, at least 2.5% by volume of a R-rich phase and less than 1% by volume of a B-rich phase, said permanent magnet having a maximum product ($BH_{max}$) of at least 38.0 MGOe.

15. The permanent magnet according to claim 14, wherein the oxygen content of the alloy ranges from 0.005 to 0.03% by weight.

16. The permanent magnet according to claim 14, wherein the content of the B-rich phase is less than 0.5% by volume.

17. The permanent magnet according to claim 14, wherein said element comprises more than 70% by weight of Nd.

18. The permanent magnet according to claim 14, wherein the Fe-rich phase is formed of a tetragonal system of $Nd_2Fe_{14}B$.

19. The permanent magnet according to claim 14, wherein a portion of the Fe content is replaced by Co, Al or Co+Al.

20. The permanent magnet according to claim 19, wherein the content of Co is 1 to 20% by weight and the content of Al is 0.4 to 2% by weight (as measured on the basis of the content of Fe).

21. A permanent magnet having a maximum energy product ($BH_{max}$) of at least 38.0 MGOe, comprising at least 96.5% by volume of a ferromagnetic Fe-rich phase as the main phase, at least 2.5% by volume of an R-rich phase and less than 1% by volume of a B-rich phase, manufactured by a process comprising the steps of:

(i) preparing an alloy consisting essentially of about 10–40% by weight of R, about 0.8 to 1.1% by weight of boron with the balance being iron, wherein R is at least one element selected from the group consisting of yttrium and the rare earth elements;

(ii) pulverizing the alloy into a powder;

(iii) molding said powder in a magnetic field thereby obtaining a molded mass; and (iv) sintering the molded mass at a temperature of about 1000°–1200° C. in an atmosphere of $5\times10^{-1}$ Torr or less to obtain said permanent magnet.

* * * * *